United States Patent [19]

Maeda et al.

[11] Patent Number: 5,045,383

[45] Date of Patent: Sep. 3, 1991

[54] THERMOSENSITIVE IMAGE TRANSFER RECORDING MEDIUM

[75] Inventors: Mitsuru Maeda, Shizuoka; Minoru Hakiri; Kazuhiro Hasebe, both of Numazu; Masaaki Kobayashi, Tokyo; Hiroki Sugiyama, Mishima, all of Japan

[73] Assignee: Ricoh Company, Ltd., Tokyo, Japan

[21] Appl. No.: 456,465

[22] Filed: Dec. 26, 1989

Related U.S. Application Data

[63] Continuation-in-part of Ser. No. 296,025, Jan. 12, 1989, abandoned.

[30] Foreign Application Priority Data

| | | | |
|---|---|---|---|
| Jan. 18, 1988 | [JP] | Japan | 63-8876 |
| May 18, 1988 | [JP] | Japan | 63-120841 |
| May 8, 1989 | [JP] | Japan | 1-113667 |

[51] Int. Cl.[5] ..... B41M 5/26

[52] U.S. Cl. ..... 428/216; 428/195; 428/336; 428/423.1; 428/475.5; 428/480; 428/484; 428/488.1; 428/488.4; 428/500; 428/522; 428/913; 428/914

[58] Field of Search ..... 428/195, 216, 336, 423.1, 428/475.5, 480, 484, 488.1, 488.4, 500, 522, 913, 914

[56] References Cited

FOREIGN PATENT DOCUMENTS

| | | | |
|---|---|---|---|
| 30892 | 3/1981 | Japan | 428/488.1 |
| 196394 | 10/1985 | Japan | 428/488.4 |
| 225795 | 11/1985 | Japan | 428/195 |

*Primary Examiner*—Pamela R. Schwartz

*Attorney, Agent, or Firm*—Oblon, Spivak, McClelland, Maier & Neustadt

[57] ABSTRACT

A thermosensitive image transfer recording medium having a support, a release layer formed thereon containing as the main components an unvulcanized rubber and a thermofusible wax component, and a thermofusible ink layer containing a coloring agent and a thermofusible resin component, with addition of a thermofusible wax component thereto when necessary, formed on the release layer. Further, the release layer may consist of two sub-release layers which are successively overlaid on the support, with one of the sub-release layers containing the thermofusible wax component, and the other sub-release layer containing the unvulcanized rubber and the thermofusible wax component. The thermosensitive image transfer recording medium may further include a mat layer containing a pigment and a binder agent between the support and the release layer, and if necessary an overcoat layer on the thermofusible ink layer, which contains a thermofusible wax component or a mixture of a thermofusible wax component and a thermofusible resin component.

51 Claims, 2 Drawing Sheets

THERMOSENSITIVE IMAGE TRANSFER RECORDING MEDIUM

This application is a continuation-in-part of application Ser. No. 07/296,025, filed Jan. 12, 1989, now abandoned.

BACKGROUND OF THE INVENTION

The present invention relates to a thermosensitive image transfer recording medium for use with printers for computers and word processors, and bar code printers, and more particularly to a thermosensitive image transfer recording medium from which images are thermally transferred onto a transfer sheet by utilizing the thermofusibility of a thermofusible ink layer thereof.

Conventionally, there is widely known the thermosensitive image transfer recording method as a convenient method of recording images on a sheet of plain paper. This thermosensitive image transfer recording is carried out in such a manner that a thermofusible ink layer of the thermosensitive image transfer recording medium is melted with application of heat by a thermal head and an ink composition of the thermofusible ink layer is imagewise transferred to a transfer sheet, which is superimposed on the thermosensitive image transfer recording medium, opposite to the thermal head with respect to the recording medium.

The above-mentioned thermosensitive image transfer recording medium, generally called an ink ribbon, basically comprises a support and a thermofusible ink layer formed thereon. More specifically, a representative thermosensitive image transfer recording media is constructed in such a fashion that a thermofusible ink layer comprising as the main components a coloring agent, a thermofusible wax component such as waxes, and/or a binder agent such as a resin having a low-melting point (hereinafter referred to as a thermofusible resin) is formed on a support.

Another representative thermosensitive image transfer recording medium is constructed by interposing a release layer comprising as the main component a wax between the support and the thermofusible ink layer. This thermosensitive image transfer recording medium has an advantage in that an ink component contained in the thermofusible ink layer is fused and transferred onto the transfer sheet smoothly. However, even though the release layer is provided in the conventional thermosensitive image transfer recording medium, the image quality obtained by the above conventional thermosensitive image transfer recording medium is greatly influenced by the surface smoothness of the transfer sheet, so that it is difficult to obtain high quality images on the transfer sheet, for example, on a bond paper which has a low surface smoothness, by the conventional thermosensitive image transfer recording medium.

For the purpose of mitigating the above-mentioned shortcomings, a variety of proposals have been made. For example, heat treatment is performed after images are transferred to the transfer sheet as disclosed in Japanese Laid-Open Patent Application 58-76276; an auxiliary means of improving the image quality is taken in the course of the image transfer by using magnetic force, as disclosed in Japanese Laid-Open Patent Application 52-96549, or by using electrostatic force as disclosed in Japanese Laid-Open Patent Application 55-65590; an oily material is added to the thermofusible ink layer to reduce the melting viscosity thereof as disclosed in Japanese Laid-Open Patent Application 60-25762; and a thermal-decomposable material is added to the thermofusible ink layer for thermal sensitization of the ink layer as disclosed in Japanese Laid-Open Patent Application 60-82389, or a thermalexpansible material is added to the thermofusible ink layer for thermal sensitization of the ink layer as disclosed in Japanese Laid-Open Patent Application 60-25762.

Furthermore, there has been proposed a variety of the thermosensitive image transfer recording media which comprise a multi-layered type thermofusible ink layer in order to improve the image quality. For instance, lamination of two thermofusible ink layers is disclosed in Japanese Laid-Open Patent Application 59-224392. Each of the above-mentioned two thermofusible ink layers comprises an individual thermofusible ink composition having a slightly different melting point and each or both of them comprise a pigment. A further thermosensitive image transfer recording medium is disclosed in Japanese Laid-Open Patent Application 60-97888, which comprises a thermofusible material layer comprising a thermofusible material, but comprising no coloring agent, is overlaid on a thermofusible ink layer.

However, the method of melting the ink composition and transferring the melted liquid-type ink composition onto a transfer sheet for image recording has the shortcoming that the image quality on a transfer sheet having a low surface smoothness is inferior to that on a transfer sheet having a high surface smoothness. This fundamental shortcoming that the image quality depends on the surface smoothness of the transfer sheet cannot be eliminated by the conventional thermosensitive image transfer recording media.

As a method of eliminating the above-mentioned shortcoming, there has been proposed a thermosensitive image transfer recording medium comprising a thermofusible ink layer which comprises an ink composition having as the main component a resin, which becomes viscid with application of heat energy thereto, but exhibits mechanical strength to some extent, without becoming a low-viscosity liquid. In the case of this thermosensitive image transfer recording medium, even when images are transferred onto a transfer sheet having a low surface smoothness, the above-mentioned ink composition contained in the thermofusible ink layer adheres to the convex portions of the low-surface-smoothness transfer sheet, covering the concave portions thereof, and accordingly high-quality images can be obtained on the low-surface-smoothness transfer sheet.

However, the above ink composition comprising as the main component such a resin requires more thermal energy for melting the resin and transferring images onto the transfer sheet, in comparison with the conventional ink composition comprising as the main component a wax. Therefore, when the above-mentioned thermosensitive image transfer recording medium comprising a resin-type ink composition is employed, it is necessary to use a film having excellent heat resistance as a support and there are problems that the life of a thermal head is shortened and the built-up heat in the thermal head degrades the image quality.

Furthermore, there is known a conventional thermosensitive image transfer recording medium comprising a support and a thermofusible ink layer, formed on the support, which comprises as the main components a thermofusible wax component such as paraffin wax and a coloring agent such as a dye and a pigment. In this conventional thermosensitive image transfer recording medium, the mechanical strength of the thermofusible wax component is so poor that the abrasion resistance of the transferred image is insufficient for use in practice.

To solve the above problem, a low-melting resin is added to the thermofusible ink layer. As the amount of the resin component is increased, the adhesive force of the thermofusible ink layer to the support is strengthened, but this is disadvantageously accompanied by the difficulty in the transfer of the ink components of the ink layer from the support. In addition to the above, the more the amount of the resin component in the thermofusible ink layer, the lower the thermosensitivity of the thermofusible ink layer. As another countermeasure, there is a trial of making the thermofusible ink layer as thin as possible. However, this makes the transferred images less uniform and the image density thereof lower.

To lower the adhesive strength of the thermofusible ink layer to the support even when the amount of the resin component is increased in the thermofusible ink layer, it is proposed that a water- or solvent-dispersed powdery ink component be contained in a thermofusible ink layer. This thermosensitive image transfer recording medium, however, has the shortcoming that the thermosensitivity of the thermofusible ink layer is degraded.

Occasionally, the images transferred to a transfer sheet by using a thermosensitive image transfer recording sheet are prone to become excessively glossy. Therefore various proposals have been made to roughen the surface of the images to obtain mat images.

For example, (i) A thermosensitive image transfer recording sheet in which a thermofusible ink layer is formed on a support whose surface is made rough.

(ii) A thermosensitive image transfer recording sheet in which a mat layer having a roughened surface and a thermofusible ink layer are successively overlaid on a support.

By the thermosensitive image transfer recording sheet (i), however, the object of decreasing the glossiness of transferred images cannot be achieved satisfactorily.

In the thermosensitive image transfer recording sheet (ii), the surface of the mat layer is roughened by the addition of silica thereto. When the amount of silica is increased to sufficiently decrease the surface glossiness of the ink component formed on the transfer sheet, the adhesive force of the mat layer to the support is so decreased that the thermofusible ink layer tends to be transferred to a transfer sheet together with the mat layer.

SUMMARY OF THE INVENTION

It is therefore a first object of the present invention to provide an improved thermosensitive image transfer recording medium which is capable of yielding high quality images, not only on a transfer having high surface smoothness sheet, but also on a transfer sheet having low surface smoothness.

A second object of the present invention is to provide an improved thermosensitive image transfer recording medium having high thermosensitivity, capable of yielding grayed or mat images having high image density, as well as high abrasion resistance.

The first object of the present invention can be attained by a thermosensitive image transfer recording medium comprising a support, a release layer comprising as the main component an unvulcanized rubber, and a thermofusible ink layer comprising a thermofusible resin component and a coloring agent, with addition of a thermofusible wax component thereto when necessary, which layers are successively overlaid on the support in this order.

The second object of the present invention can be attained by interposing a mat layer having a rough surface between the support and the release layer in such a fashion that the mat layer is fixed to the support in the above-mentioned thermosensitive image transfer recording medium.

DETAILED DESCRIPTION OF THE PREFERRED EMBODIMENTS

Figure 1:
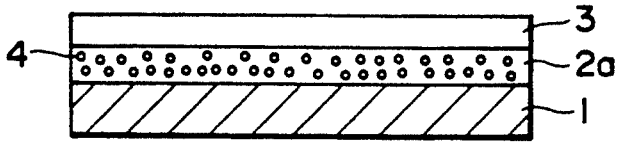
FIG. 1 through FIG. 7B are schematic cross-sectional views of examples of a thermosensitive image transfer recording medium according to the present invention.

The thermosensitive image transfer recording medium according to the present invention may be embodied, for example, in the following seven types:

(1) A thermosensitive image transfer recording medium comprising a support 1, a release layer 2*a* comprising as the main component an unvulcanized rubber 4, and a thermofusible ink layer 3 comprising a thermofusible resin component and a coloring agent, which layers are successively overlaid in this order on the support 1 as shown in FIG. 1.

Figure 2:
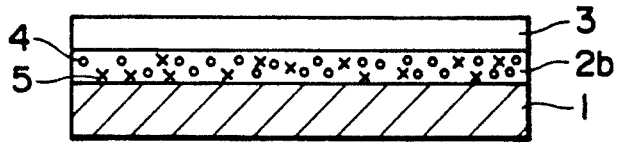

(2) A thermosensitive image transfer recording medium comprising a support 1, a release layer 2*b* comprising as the main components an unvulcanized rubber 4 and a thermofusible wax component 5, and a thermofusible ink layer 3 comprising a thermofusible resin component and a coloring agent, which layers are successively overlaid in this order on the support 1, as shown in FIG. 2.

Figure 3A:
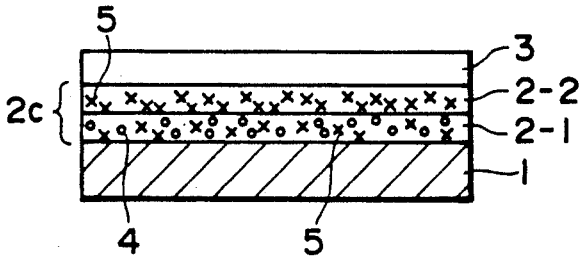
Figure 3B:
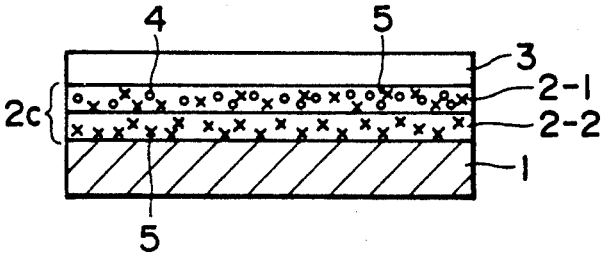

(3) A thermosensitive image transfer recording medium comprising a support 1, a release layer 2*c* comprising a sub-release layer 2-1 and a sub-release layer 2-2, and a thermofusible ink layer 3, which layers are successively overlaid on the support 1 as illustrated in FIG. 3A or FIG. 3B. Any of the sub-release layers 2-1 and 2-2 may be formed on the support 1. In this thermosensitive image transfer recording medium, one of the sub-release layers 2-1 and 2-2 comprises as the main component a thermofusible wax component 5, and the other sub-release layers comprises as the main components an unvulcanized rubber 4 and a thermofusible wax component 5 as illustrated in FIG. 3A and FIG. 3B.

Figure 4:
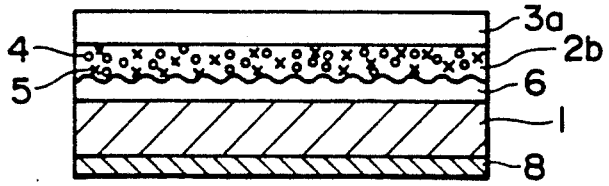

(4) A thermosensitive image transfer recording medium comprising a support 1, a mat layer 6, a release layer 2*b* comprising as the main components an unvulcanized rubber 4 and a thermofusible wax component 5, and a thermofusible ink layer 3*a* comprising a coloring agent, a thermofusible wax component and a thermofusible resin component, which layers are successively overlaid in this order on the support 1, when necessary, with the provision of a heat-resistant layer 8, on the other side of the support 1, opposite to the mat layer 6, as shown in FIG. 4.

Figure 5:
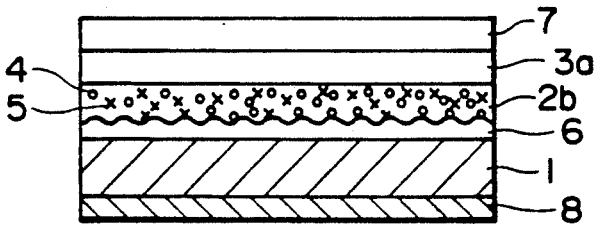

(5) A thermosensitive image transfer recording medium comprising a support 1, a mat layer 6, a release layer 2*b* comprising as the main components an unvulcanized rubber 4 and a thermofusible wax component 5, a thermofusible ink layer 3*a* comprising a coloring agent, a thermofusible wax component and a thermofusible resin component, and an overcoat layer 7 comprising as the main component a thermofusible wax component or a mixture of a thermofusible wax component and a thermofusible resin component, which layers are successively overlaid in this order on the support 1, when necessary, with the provision of a heat-resistant layer 8, on the other side of the support 1, opposite to the mat layer 6, as shown in FIG. 5.

Figure 6A:
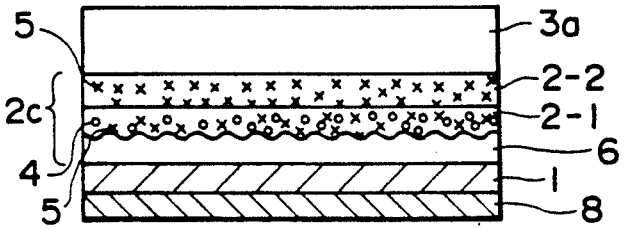
Figure 6B:
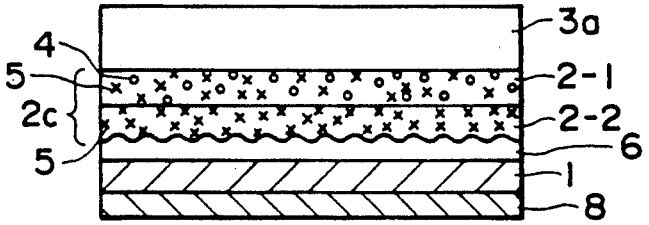

(6) A thermosensitive image transfer recording medium comprising a support 1, a mat layer 6, a release layer 2*c* comprising a sub-release layer 2-1 and a sub-release layer 2-2, and a thermofusible ink layer 3*a*, which layers are successively overlaid on the support 1 as illustrated in FIG. 6A or FIG. 6B. Any of the sub-release layers 2-1 and 2-2 may be formed on the mat layer 6. In this thermosensitive image transfer recording medium, one of the sub-release layers 2-1 and 2-2 comprises as the main component a thermofusible wax component 5, and the other sub-release layer comprises as the main components an unvulcanized rubber 4 and a thermofusible wax component 5, when necessary, with the provision of a heat-resistant layer 8, on the other side of the support 1, opposite to the mat layer 6, as illustrated in FIG. 6A and FIG. 6B.

Figure 7A:
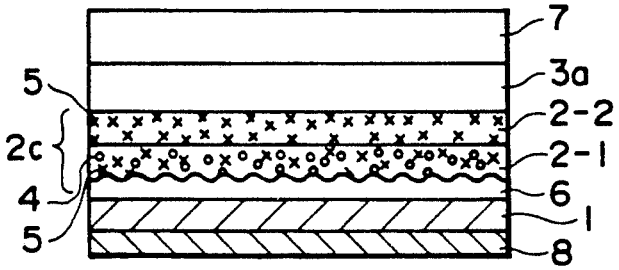
Figure 7B:
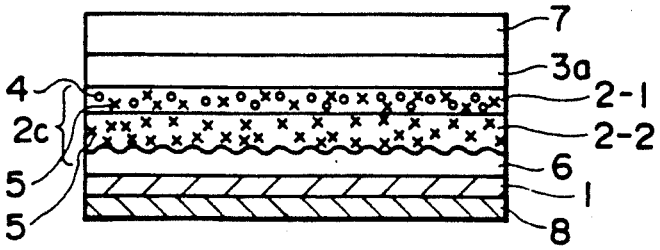

(7) A thermosensitive image transfer recording medium comprising a support 1, a mat layer 6, a release layer 2*c* comprising a sub-release layer 2-1 and a sub-release layer 2-2, a thermofusible ink layer 3*a*, and an overcoat layer 7 comprising as the main component a thermofusible wax component or a mixture of a thermofusible wax component and a thermofusible resin component, which layers are successively overlaid on the support 1 as illustrated in FIG. 7A or FIG. 7B. Any of the sub-release layers 2-1 and 2-2 may be formed on the mat layer 6. In this thermosensitive image transfer recording medium, one of the sub-release layers 2-1 and 2-2 comprises as the main component a thermofusible wax component 5, and the other sub-release layer comprises as the main components an unvulcanized rubber 4 and a thermofusible wax component 5, when necessary, with the provision of a heat-resistant layer 8, on the other side of the support 1, opposite to the mat layer 6, as illustrated in FIG. 7A and FIG. 7B.

A key feature of the thermosensitive image transfer recording medium according to the present invention is that the release layer 2 comprises as the main component a unvulcanized rubber. However, with respect to the abrasion resistance of the transferred images, the thermosensitive image transfer recording medium (2) is improved in comparison with the thermosensitive image transfer recording medium (1). This is because of the slip characteristics of the transferred images can be improved by the use of the vulcanized rubber 4 and the thermofusible wax component 5 in combination in the thermosensitive image transfer recording medium (2). In the thermosensitive image transfer recording medium (3), the abrasion resistance of the transferred images can be further improved due to the structure of the release layer 2 as explained above.

The mat layer for use in the present invention comprises finely-divided particles of a pigment and a binder agent.

Examples of the pigment for use in the mat layer in the present invention are organic materials such as silicone resin and polytetrafluoroethylene; and inorganic materials such as silicone-coated silica, clay, alumina, calcium carbonate, titanium oxide and zinc oxide. It is preferable that the particle diameter of the above-mentioned pigment for use in the mat layer 6 be 0.1 μm to 3 μm.

Examples of the binder agent for use in the mat layer are polyester resin, vinyl chloride-vinyl acetate copolymer, ethyl cellulose and epoxy resin.

It is preferable that the weight ratio of the pigment to the binder agent in the mat layer be in the range of (1:20) to (5:1), more preferably in the range of (1:10) to (2:1).

It is preferable that the thickness of the mat/layer for use in the present invention be in the range of about 1 to 10 μm.

Specific examples of the unvulcanized rubber for use in the release layer 2 in the present invention are polyisoprene, polybutadiene, styrene-butadiene rubber, nitrile rubber, ethylene propylene rubber, butyl rubber, silicone rubber, fluororubber and urethane rubber. Among the above examples, polyisoprene, polybutadiene, ethylene propylene rubber, butyl rubber and nitrile rubber are preferable for use in the present invention. These preferable unvulcanized rubbers have melting points ranging from 60° C. to 200° C.

Specific examples of the thermofusible wax component for use in the release layer 2 in the present invention are natural waxes such as carnauba wax, candelilla wax, beeswax, Japan wax, montan wax and spermaceti; synthetic waxes such as paraffin wax, microcrystalline wax, oxidized wax and high-density polyethylene wax; higher fatty acids, derivatives thereof and metallic salts thereof, such as margaric acid, lauric acid, myristic acid, palmitic acid, stearic acid, and behenic acid; higher alcohols such as stearyl alcohol and behenyl alcohol; esters such as fatty acid ester of sorbitan; and amides such as stearamide and oleylamide. Among the above, waxes such as carnauba wax, montan wax and high-density polyethylene, and higher fatty acids and derivatives thereof are preferable for use in the present invention.

When the release layer 2*a*, 2*b* or 2*c* of the thermosensitive image transfer recording medium according to the present invention comprises an unvulcanized rubber and a thermofusible wax component, it is preferable that the amount ratio by parts by weight of the unvulcanized rubber to the thermofusible wax component be in the range of (5~95) to (95~5), more preferably in the range of (30~70) to (70~30), for obtaining transferred images with high abrasion resistance and high image quality even on a low-surface-smoothness transfer sheet.

In the thermosensitive image transfer recording media (1), (2), (4) and (5), it is preferable that the thickness of the release layer 2 be in the range of 0.2 to 5 μm, more preferably in the range of 1 to 4 μm. In the thermosensitive image transfer recording medium (3), (6) and (7), it is preferable that the thickness of a first sub-release layer to be placed on the support 1 be in the range of 0.1 to 2 μm, more preferably in the range of 0.5 to 1.5 μm, and the thickness of a second sub-release layer to be placed on the first sub-release layer be in the range of 0.2 to 3 μm, more preferably in the range of 0.5 to 2 μm.

Any release layers for use in the present invention can be formed by coating an organic solvent solution or a dispersion of the necessary components therefor on the support 1 or the mat layer 6. In this case, as the solvents for use in the solution, for example, toluene, methyl ethyl ketone and ethyl acetate can be employed. In the case of the dispersion, an aqueous dispersion may also be employed. Furthermore, the release layers may be formed on the support 1 or the mat layer 6 by the hot melt coating without using any solvents.

The thermofusible ink layer comprises as the main components a coloring agent and a thermofusible resin component having a relatively low melting point, to which a thermofusible wax component may be added when necessary.

The coloring agent for use in the thermofusible ink layer in the present invention can be selected from a variety of conventional dyes and pigments. For example, the following dyes, pigments and mixtures thereof can be employed: carbon black, Nigrosine dye (C.I. No. 504158), Aniline Blue (C.I. No. 50405), Calconyl Blue (C.I. Azess Blue 3), Chrome Yellow (C.I. No. 14090), Ultramarine Blue (C.I. 77103), Methylene Blue Chloride (C.I. No. 52015), Phthalocyanine Blue (C.I. No. 74160), Du Pont Oil Red (C.I. No. 26105), Quinoline Yellow C.I. No. 47005), Malachite Green Oxalate (C.I. No. 42000), Lamp Black (C.I. No. 77266), Rose Bengale (C.I. No. 45435) and Zabon First Black (C.I. No. 12195 Solvent Dye).

The thermofusible wax component in the thermofusible ink layer may be the same as those employed in the release layer, which are previously mentioned.

Specific examples of the thermofusible resin component for use in thermofusible ink layer are polyamide resin, polyester resin, polyurethane resin, vinyl chloride resin, cellulosic resin, petroleum resin, styrene resin, butyral resin, phenolic resin, ethylene-vinyl acetate copolymer and ethylene-acrylic resin.

It is preferable that the amount ratio by parts by weight of the coloring agent, the thermofusible wax component and the thermofusible resin be in the range of (5~50):(30~90):(5~50).

The thermofusible ink layer can be formed, in the same manner as employed in the release layer, by coating an organic solvent solution or a water-soluble dispersion on the release layer, or by the hot melt coating.

It is preferable that the thickness of the thermofusible ink layer be in the range of 0.5 to 5 μm, more preferably in the range of 1 to 3 μm.

In addition to the above, other components, for example, a plasticizer such as fatty ester, glycol ester, phosphate ester and epoxidized linseed oil, and a flexibilizer made of an oily material such as mineral oil, animal oil, vegetable oil, liquid paraffin and silicone oil, may be added to the release layer and the thermofusible ink layer in a small amount up to 30 wt.% of the entire weight of each layer. Furthermore, any of the conventional coloring agents may be added to the release layer, if it is in a small amount.

In the thermosensitive image transfer recording medium (5) and (7), the overcoat layer 7 provided on the thermofusible ink layer 3*a* comprises as the main component a thermofusible wax component or a mixture of a thermofusible wax component and a thermofusible resin component. The thermofusible wax component and the thermofusible resin component may be the same as those employed in the release layers of the thermosensitive image transfer recording media of the present invention, respectively.

It is preferable that the overcoat layer 7 generally have a thickness of 0.2 μm to 3 μm, more preferably 0.5 μm to 2 μm.

The overcoat layer 7 can be formed by coating an organic solvent solution or a dispersion of the necessary components therefor on the thermofusible ink layer 3*a*. In this case, as the solvents for use in the solution, for example, toluene, methyl ethyl ketone and ethyl acetate can be employed. In the case of the dispersion, an aqueous dispersion may also be employed. Furthermore, the overcoat layer 7 may be formed on the thermofusible ink layer 3*a* by the hot melt coating without using any solvents.

As mentioned previously, the above-mentioned release layer 2*a* or 2*b* and the thermofusible ink layer 3 or 3*a* are successively overlaid on a support 1 or on a mat layer 6. Specific examples of the support material for use in the present invention are heat-resistant plastic films made of polyester, polycarbonate, triacetyl cellulose, polyamide resin and polyimide resin; cellophane sheet; parchment paper; and condenser paper. When necessary, a heat-resistant layer may be formed on the support 1 by coating, on one side of the support, with which side a thermal head is brought into contact, the heat-resistant resins such as silicone resin, fluoroplastics, polyimide resin, epoxy resin, phenolic resin, melamine resin and cellulosic resin.

The present invention will now be explained more in detail by referring to the following examples.

Example 1

[Preparation of Release Layer]

A mixture of the following components was coated by a wire bar on one side of a 3.5 μm thick polyester film serving as a support, and dried, so that a release layer having a thickness of 1 μm was formed on the support.

| | Parts by Weight |
|---|---|
| Unvulcanized ethylene propylene rubber | 5 |
| Methyl ethyl ketone (MEK) | 95 |

[Preparation of Thermofusible Ink Layer]

A mixture of the following components was dispersed in a ball mill for 12 hours. The thus obtained dispersion was coated on the above formed release layer by a wire bar and dried, so that a thermofusible ink layer having a thickness of 2.5 μm was formed on the release layer.

| | Parts by Weight |
|---|---|
| Carbon black | 3 |
| Candelilla wax | 10.5 |
| Ethylene - vinyl acetate copolymer | 1.5 |
| Toluene | 85 |

On the other side of the support, opposite to the release layer, a silicone resin was coated by a smoothing bar to form a heat-resistant layer having a thickness of 0.1 μm thereon, whereby a thermosensitive image transfer recording medium No. 1 according to the present invention, as shown in FIG. 1, was prepared.

Example 2

Example 1 was repeated except that the unvulcanized ethylene propylene rubber in the formulation of the release layer coating liquid employed in Example 1 was replaced by an unvulcanized polyisoprene rubber, and that the thickness of the release layer was changed from 1 μm to 0.5 μm, whereby a thermosensitive image transfer recording medium No. 2 according to the present invention, as shown in FIG. 1, was prepared.

Example 3

Example 1 was repeated except that the formulation of the release layer coating liquid employed in Example 1 was changed to the following formulation, and a mixture of the following components was dispersed in a ball mill for 12 hours, whereby a thermosensitive image transfer recording medium No. 3 according to the present invention, as shown in FIG. 1, was prepared.

| | Parts by Weight |
|---|---|
| 10% toluene solution of unvulcanized butyl rubber | 99 |
| Carbon black | 1 |

Example 4

Example 1 was repeated except that the formulation of the release layer coating liquid employed in Example 1 was changed to the following formulation, and a mixture of the following components was dispersed in a ball mill for 12 hours, whereby a thermosensitive image transfer recording medium No. 4 according to the present invention, as shown in FIG. 1, was prepared.

| | Parts by Weight |
|---|---|
| 10% toluene solution of unvulcanized polybutadiene | 99 |
| Carbon black | 1 |

Example 5

Example 2 was repeated except that the formulation of the release layer coating liquid employed in Example 2 was changed to the following formulation, whereby a thermosensitive image transfer recording medium No. 5 according to the present invention, as shown in FIG. 1, was prepared.

| | Parts by Weight |
|---|---|
| Unvulcanized nitrile rubber | 5 |
| Toluene | 95 |

Comparative Example 1

Example 1 was repeated except that the release layer employed in Example 1 was not formed on the support, whereby a comparative thermosensitive image transfer recording medium No. 1 was prepared.

Comparative Example 2

Example 1 was repeated except that the release layer employed in Example 1 was replaced by a release layer which was prepared by coating paraffin on the support by the hot melt coating method, whereby a comparative thermosensitive image transfer recording medium No. 2 was prepared.

Example 6

[Preparation of Release Layer]

A mixture of the following components was coated by a wire bar on one side of a 3.5 μm thick polyester film serving as a support, and dried, so that a release layer having a thickness of 1 μm was formed on the support.

| | Parts by Weight |
|---|---|
| Unvulcanized ethylene propylene rubber | 7 |
| Carnauba wax | 3 |
| Methyl ethyl ketone (MEK) | 90 |

[Preparation of Thermofusible Ink Layer]

A mixture of the following components was dispersed in a ball mill for 12 hours. The thus obtained dispersion was coated on the above formed release layer by a wire bar and dried, so that a thermofusible ink layer having a thickness of 2.5 μm was formed on the release layer.

| | Parts by Weight |
|---|---|
| Carbon black | 3 |
| Carnauba wax | 10.5 |
| Ethylene - vinyl acetate copolymer | 1.5 |
| Toluene | 85 |

On the other side of the support, opposite to the release layer, a silicone resin was coated by a smoothing bar to form a heat-resistant layer having a thickness of 0.1 μm thereon, whereby a thermosensitive image transfer recording medium No. 6 according to the present invention, as shown in FIG. 2, was prepared.

Example 7

Example 2 was repeated except that the formulation of the release layer coating liquid employed in Example 2 was changed to the following formulation, whereby a thermosensitive image transfer recording medium No. 7 according to the present invention, as shown in FIG. 2, was prepared.

| | Parts by Weight |
|---|---|
| Unvulcanized polyisoprene rubber | 7 |
| Carnauba wax | 3 |
| Toluene | 90 |

Example 8

Example 1 was repeated except that the formulation of the release layer coating liquid employed in Example 1 was changed to the following formulation and a mixture of the following components was dispersed in a ball mill for 12 hours, whereby a thermosensitive image transfer recording medium No. 8 according to the present invention, as shown in FIG. 2, was prepared.

| | Parts by Weight |
|---|---|
| 10% toluene solution of unvulcanized butyl rubber | 50 |
| Amino-resin-modified montan wax | 5 |
| Toluene | 45 |

Example 9

Example 1 was repeated except that the formulation of the release layer coating liquid employed in Example 1 was changed to the following formulation, whereby a thermosensitive image transfer recording medium No. 9 according to the present invention, as shown in FIG. 2, was prepared.

| | Parts by Weight |
|---|---|
| Unvulcanized nitrile rubber | 3 |
| Zinc stearate | 7 |
| Toluene | 90 |

Example 10

[Preparation of First Release Layer]

A mixture of the following components was dispersed in a ball mill for 12 hours. The thus obtained dispersion was coated by a wire bar on one side of the same polyester film as that employed in Example 1, and dried, so that a first sub-release layer having a thickness of 0.5 μm was formed on the support.

| | Parts by Weight |
|---|---|
| Ethylene propylene rubber | 8 |
| Carnauba wax | 2 |
| Methyl ethyl ketone (MEK) | 90 |

[Preparation of Second Release Layer]

A mixture of the following components was dispersed in a ball mill for 12 hours. The thus obtained dispersion was coated on the above-prepared first sub-release layer by a wire bar and dried, so that a second sub-release layer having a thickness of 1 μm was formed on the first sub-release layer. Thus a release layer was formed on the support.

| | Parts by Weight |
|---|---|
| Carnauba wax | 10 |
| Toluene | 90 |

[Preparation of Thermofusible Ink Layer]

A mixture of the following components was dispersed in a ball mill for 12 hours. The thus obtained dispersion was coated on the above-prepared second sub-release layer of the release layer by a wire bar and dried, so that a thermofusible ink layer having a thickness of 2.5 μm was formed on the second sub-release layer.

| | Parts by Weight |
|---|---|
| Carbon black | 3 |
| Candelilla wax | 10.5 |
| Ethylene - vinyl acetate copolymer | 1.5 |
| Toluene | 85 |

On the other side of the support, opposite to the first release layer, the silicone resin was coated by a smoothing bar to prepare a heat-resistant layer having a thickness of 0.1 μm, whereby a thermosensitive image transfer recording medium No. 10 according to the present invention, as shown in FIG. 3A, was prepared.

Example 11

Example 10 was repeated except that the carnauba wax in the formulation of the first sub-release layer employed in Example 10 was replaced by montan wax, whereby a thermosensitive image transfer recording medium No. 11 according to the present invention, as shown in FIG. 3A, was prepared.

Example 12

[Preparation of First Sub-release Layer]

A mixture of the following components was dispersed in a ball mill for 12 hours. The thus obtained dispersion was coated on one side of the same polyester film as that employed in Example 1, and dried, so that a first sub-release layer having a thickness of 1 μm was formed on the support.

| | Parts by Weight |
|---|---|
| Unvulcanized polyisoprene rubber | 5 |
| Carnauba wax | 5 |
| Toluene | 90 |

[Preparation of Second Sub-release Layer]

A mixture of the following components was dispersed in a ball mill for 12 hours. The thus obtained dispersion was coated on the above formed first sub-release layer by a wire bar and dried, so that a second sub-release layer having a thickness of 1.5 μm was formed on the first sub-release layer. Thus a release layer was formed on the support.

| | Parts by Weight |
|---|---|
| High-density polyethylene wax | 10 |
| Toluene | 90 |

[Preparation of Thermofusible Ink Layer]

A mixture of the following components was dispersed in a ball mill for 12 hours. The thus obtained dispersion was coated on the above-prepared second sub-release layer of the release layer by a wire bar and dried, so that a thermofusible ink layer having a thickness of 2.5 μm was formed on the second sub-release layer.

| | Parts by Weight |
|---|---|
| Carbon black | 3 |
| Candelilla wax | 10.5 |
| Ethylene - vinyl acetate copolymer | 1.5 |
| Toluene | 85 |

On the other side of the support, opposite to the first release layer, the silicone resin was coated by a smoothing bar to prepare a heat-resistant layer having a thickness of 0.1 μm, whereby a thermosensitive image transfer recording medium No. 12 according to the present invention, as shown in FIG. 3A, was prepared.

Example 13

Example 12 was repeated except that the carnauba wax in the formulation of the first sub-release layer employed in Example 12 was replaced by montan wax, whereby a thermosensitive image transfer recording medium No. 13 according to the present invention, as shown in FIG. 3A, was prepared.

Comparative Example 3

Example 10 was repeated except that the first sub-release layer employed in Example 10 was not formed on the support, whereby a comparative thermosensitive image transfer recording medium No. 3 was prepared.

Example 14

[Preparation of First Sub-release Layer]

A mixture of the following components was dispersed in a ball mill for 12 hours. The thus obtained dispersion was coated by a wire bar on one side of the same polyester film as that employed in Example 1, and dried, so that a first sub-release layer having a thickness of 1 μm was formed on the support.

| | Parts by Weight |
|---|---|
| Carnauba wax | 10 |
| Toluene | 90 |

[Preparation of Second Sub-release Layer]

A mixture of the following components was dispersed in a ball mill for 12 hours. The thus obtained dispersion was coated on the above formed first sub-release layer by a wire bar and dried, so that a second sub-release layer having a thickness of 0.5 μm was formed on the first sub-release layer. Thus, a release layer was formed on the support.

| | Parts by Weight |
|---|---|
| Unvulcanized polyisoprene rubber | 7 |
| Carnauba wax | 3 |
| Toluene | 90 |

[Preparation of Thermofusible Ink Layer]

A mixture of the following components was dispersed in a ball mill for 12 hours. The thus obtained dispersion was coated on the above formed second sub-release layer by a wire bar and dried, so that a thermofusible ink layer having a thickness of 2.5 μm was formed on the second sub-release layer.

| | Part by Weight |
|---|---|
| Carbon black | 3 |
| Candelilla wax | 10.5 |
| Ethylene - vinyl acetate copolymer | 1.5 |
| Toluene | 85 |

On the other side of the support, opposite to the first release layer, the silicone resin was coated by a smoothing bar to prepare a heat-resistant layer having a thickness of 0.1 μm, whereby a thermosensitive image transfer recording medium No. 14 according to the present invention, as shown in FIG. 3B, was prepared.

Example 15

Example 14 was repeated except that the carnauba wax in the formulation of the second sub-release layer employed in Example 14 was replaced by montan wax, whereby a thermosensitive image transfer recording medium No. 15 according to the present invention, as shown in FIG. 3B, was prepared.

Example 16

Example 14 was repeated except that the carnauba wax in the formulation of the first sub-release layer employed in Example 14 was replaced by polyethylene wax, whereby a thermosensitive image transfer recording medium No. 16 according to the present invention, as shown in FIG. 3B, was prepared.

Example 17

Example 14 was repeated except that the carnauba wax in the formulation of the first sub-release layer employed in Example 14 was replaced by polyethylene wax and the carnauba wax in the formulation of the second sub-release layer employed in Example 14 was replaced by montan wax, whereby a thermosensitive image transfer recording medium No. 17 according to the present invention, as shown in FIG. 3B, was prepared.

Each of the thus obtained thermosensitive image transfer recording media No. 1 to No. 17 according to the present invention and the comparative thermosensitive image transfer recording media No. 1 to No. 3 was incorporated into a thermosensitive image transfer printer. A sheet of high quality paper having a high surface smoothness and a sheet of bond paper having a low surface smoothness were brought into contact with the thermofusible ink layer side of each thermosensitive image transfer recording medium, so that an image transfer recording test was performed with application of a thermal energy of 0.5 mJ/dot for printing images on each image transfer sheet for evaluation of the printed images.

Furthermore, the thus obtained images by use of each thermosensitive image transfer recording medium were subjected to an abrasion test at a room temperature of 20° C. and 50° C. for the evaluation of abrasion resistance of images.

The results are given in Table 1. In the table, mark "o" indicates that small non-printed dot-shaped spots (i.e., white dots) were scarcely observed and mark "Δ" indicates that the white dots were observed in several places. Furthermore, in the measurement of the abrasion resistance of the images, each printed bar code image sample was rubbed reciprocatively 100 times by a rub tester with a piece of corrugated board attached thereto brought into contact therewith under application of a pressure of 70 g/cm$^2$. The abrasion resistance is expressed in terms of the correct reading ratio (%) of the above rubbed bar-code-image sample by the bar code reader.

As can be seen from the results in the table, according to the present invention, the release layer of the thermosensitive image transfer recording medium comprises at least an unvulcanized rubber, so that produced images are clear even on a transfer sheet having a low surface smoothness and free from the non-printed dot-shaped dots. Furthermore, when the thermosensitive wax component is added to the above-mentioned release layer, the abrasion resistance of transferred images is remarkably improved.

TABLE 1

| Example No. | High-surface-smoothness Paper (Smoothness of 200 sec.) Image Density | White Dot | Bond Paper (Smoothness of 10 sec.) Image Density | White Dot | Abrasion Resistance (%) 20° C. | 50° C. | Comments |
|---|---|---|---|---|---|---|---|
| Example No. 1 | 1.22 | ○ | 1.21 | ○ | 65 | 0 | |
| Example No. 2 | 1.23 | ○ | 1.20 | ○ | 60 | 0 | |
| Example No. 3 | 1.25 | ○ | 1.21 | ○ | 60 | 0 | |
| Example No. 4 | 1.26 | ○ | 1.21 | ○ | 75 | 0 | |
| Example No. 5 | 1.24 | ○ | 1.22 | ○ | 70 | 0 | |
| Example No. 6 | 1.30 | ○ | 1.26 | ○ | 100 | 100 | |
| Example No. 7 | 1.35 | ○ | 1.30 | ○ | 100 | 100 | |
| Example No. 8 | 1.36 | ○ | 1.30 | ○ | 100 | 100 | |
| Example No. 9 | 1.31 | ○ | 1.24 | ○ | 100 | 100 | |
| Example No. 10 | 1.32 | ○ | 1.27 | ○ | 100 | 100 | |
| Example No. 11 | 1.35 | ○ | 1.29 | ○ | 100 | 100 | |
| Example No. 12 | 1.30 | ○ | 1.25 | ○ | 100 | 100 | |
| Example No. 13 | 1.32 | ○ | 1.22 | ○ | 100 | 100 | |
| Example No. 14 | 1.33 | ○ | 1.24 | ○ | 100 | 100 | |
| Example No. 15 | 1.32 | ○ | 1.23 | ○ | 100 | 100 | |
| Example No. 16 | 1.31 | ○ | 1.24 | ○ | 100 | 100 | |
| Example No. 17 | 1.34 | ○ | 1.25 | ○ | 100 | 100 | |
| Comparative Example No. 1 | 0.88 | Δ | 0.71 | Δ | 55 | 0 | A thermofusible ink layer was peeled off the release layer and adhered to the transfer sheet. |
| No. 2 | 0.97 | Δ | 0.80 | Δ | 45 | 0 | Same as above |
| No. 3 | 0.91 | Δ | 0.74 | Δ | 78 | 12 | |

Example 18

[Preparation of Mat Layer]

A mixture of the following components was dispersed in a ball mill for 10 hours. The thus obtained dispersion was coated by a wire bar on one side of a 4.5 μm thick polyester film serving as a support 1 as shown in FIG. 4, in a deposition of 1.0 g/m$^2$ on a dry basis, and dried, so that a mat layer 6 having a thickness of 1.3 μm was formed on the support.

| | Parts by Weight |
|---|---|
| Silicone-coated silica | 3 |
| Polyester resin | 7 |
| Methyl ethyl ketone | 45 |
| Toluene | 45 |

[Preparation of Release Layer]

A mixture of the following components was heated to 80° C., subsequently cooled to 30° C., and then dispersed in a ball mill for 10 hours. The thus obtained dispersion was coated on the above formed mat layer 6 in a deposition of 1.5 g/m$^2$ on a dry basis, and dried at 60° C. for 2 minutes, so that a release layer **2*b* was formed on the mat layer 6**.

| | Parts by Weight |
|---|---|
| Carnauba wax | 6 |
| Unvulcanized butadiene rubber | 1 |
| Toluene | 93 |

[Preparation of Thermofusible Ink Layer]

A mixture of the following components was dispersed. The thus obtained dispersion was coated by a wire bar on the above formed release layer 6 in a deposition of 2.0 g/m$^2$ and dried at 60° C. for 2 minutes, so that a thermofusible ink layer 3*a* was formed on the release layer 2*b*.

| | Parts by Weight |
|---|---|
| Aqueous dispersion of carbon black (solid component of 30%) | 10 |
| Emulsion of carnauba wax (solid component of 30%) | 60 |
| Water | 30 |

On the other side of the support 1, opposite to the mat layer 6, a toluene solution of silicone resin was coated in a deposition of 0.05 g/m$^2$ on a dry basis and dried at 60° C. for 2 minutes, whereby a heat-resistant layer 8 was formed. Thus, a thermosensitive image transfer recording medium No. 18 according to the present invention, as shown in FIG. 4, was prepared.

Example 19

[Preparation of Mat Layer]

A mixture of the following components was dispersed in a ball mill for 10 hours. The thus obtained dispersion was coated by a wire bar on one side of a 4.5 μm thick polyester film serving as a support 1, in a deposition of 1.0 g/m$^2$ on a dry basis, and dried, so that a mat layer 6 having a thickness of 1.3 μm was formed on the support 1.

| | Parts by Weight |
|---|---|
| Silicone-coated silica | 3 |
| Polyester resin | 7 |
| Methyl ethyl ketone | 45 |
| Toluene | 45 |

[Preparation of First Release Layer]

A mixture of the following components was heated to 80° C., subsequently cooled to 30° C., and then dispersed in a ball mill for 10 hours. The thus obtained dispersion was coated on the above formed mat layer 6 in a deposition of 0.5 g/m$^2$ on a dry basis, and dried at 60° C. for 2 minutes, so that a first sub-release layer 2-1 was formed on the mat layer 6 as shown in FIG. 6A.

| | Parts by Weight |
|---|---|
| Unvulcanized nitrile rubber | 3 |
| Carnauba wax | 2 |
| Toluene | 95 |

[Preparation of Second Release Layer]

A mixture of the following components was dispersed in a ball mill for 10 hours. The thus obtained dispersion was coated on the above-prepared first sub-release layer 2-1 by a wire bar in a deposition of 1.5 g/m$^2$ on a dry basis and dried, so that a second sub-release layer 2-2 was formed on the first sub-release layer 2-1. Thus a release layer 2*c* was formed on the mat layer 6.

| | Parts by Weight |
|---|---|
| Carnauba wax | 10 |
| Toluene | 90 |

[Preparation of Thermofusible Ink Layer]

A mixture of the following components was dispersed in a ball mill for 10 hours. The thus obtained dispersion was coated by a wire bar on the above formed second sub-release layer in a deposition of 1.5 g/m$^2$ and dried at 60° C. for 2 minutes, so that a thermofusible ink layer was formed on the second sub-release layer 2-2.

| | Parts by Weight |
|---|---|
| Aqueous dispersion of carbon black (solid component of 30%) | 10 |
| Emulsion of carnauba wax (solid component of 30%) | 60 |
| Water | 30 |

On the other side of the support 1, opposite to the mat layer 6, a toluene solution of silicone resin was coated in a deposition of 0.05 g/m$^2$ on a dry basis and dried at 60° C. for 2 minutes, whereby a heat-resistant layer 8 was formed. Thus, a thermosensitive image transfer recording medium No. 19 according to the present invention, as shown in FIG. 6A, was prepared.

Example 20

[Preparation of Mat Layer]

A mixture of the following components was dispersed in a ball mill for 10 hours. The thus obtained dispersion was coated by a wire bar on one side of a 4.5 μm thick polyester film serving as a support 1, in a deposition of 1.0 g/m$^2$ on a dry basis, and dried, so that a mat layer 6 having a thickness of 1.3 μm was formed on the support.

| | Parts by Weight |
|---|---|
| Silicone-coated silica | 3 |
| Polyester resin | 7 |
| Methyl ethyl ketone | 45 |
| Toluene | 45 |

[Preparation of Release Layer]

A mixture of the following components was heated to 80° C., subsequently cooled to 30° C., and then dispersed in a ball mill for 10 hours. The thus obtained dispersion was coated on the above formed mat layer 6 in a deposition of 1.5 g/m$^2$ on a dry basis, and dried at 60° C. for 2 minutes, so that a release layer 2*b* was formed on the mat layer 6.

| | Parts by Weight |
|---|---|
| Carnauba wax | 6 |
| Unvulcanized butadiene rubber | 1 |
| Toluene | 93 |

[Preparation of Thermofusible Ink Layer]

A mixture of the following components was dispersed. The thus obtained dispersion was coated by a wire bar on the above formed release layer 2b in a deposition of 2.0 g/m$^2$ and dried at 60° C. for 2 minutes, so that a thermofusible ink layer 3a was formed on the release layer 2b.

| | Parts by Weight |
|---|---|
| Aqueous dispersion of carbon black (solid component of 30%) | 10 |
| Emulsion of carnauba wax (solid component of 30%) | 60 |
| Water | 30 |

[Preparation of Overcoat Layer]

A mixture of the following components was heated at 80° C. and dispersed in a ball mill for 10 hours. The thus obtained dispersion was coated by a wire bar on the above formed thermofusible ink layer 3a in a deposition of 0.5 g/m$^2$ on a dry basis and dried at 50° C. for 2 minutes, so that an overcoat layer 7 was formed on the thermofusible ink layer 3q as shown in FIG. 5.

| | Parts by Weight |
|---|---|
| Montan wax | 5 |
| Isopropyl alcohol | 95 |

On the other side of the support 1, opposite to the mat layer 6, a toluene solution of silicone resin was coated in a deposition of 0.05 g/m$^2$ on a dry basis and dried at 60° C. for 2 minutes, whereby a heat-resistant layer 8 was formed.

Thus, a thermosensitive image transfer recording medium No. 20 according to the present invention, as shown in FIG. 5, was prepared.

Example 21

The procedure for Example 19 was repeated except that an overcoat layer was further provided on the thermoensitive ink layer 3a as shown in FIG. 7 by the steps described below.

[Preparation of Overcoat Layer]

A mixture of the following components was heated at 80° C. and dispersed in a ball mill for 10 hours. The thus obtained dispersion was coated by a wire bar on the formed thermofusible ink layer 3a in a deposition of 0.5 g/m$^2$ on a dry basis and dried at 50° C. for 2 minutes, so that an overcoat layer was formed on the thermofusible ink layer 3a.

| | Parts by Weight |
|---|---|
| Montan wax | 5 |
| Isopropyl alcohol | 95 |

Thus, a thermosensitive image transfer recording medium No. 21 according to the present invention, as shown in FIG. 7A, was prepared.

Example 22

Example 18 was repeated except that the mat layer 6 was not provided on the support, whereby a thermosensitive image transfer recording medium No. 22 according to the present invention, as shown in FIG. 2, was prepared.

Comparative Example 4

Example 18 was repeated except that the formulation of the release layer coating liquid employed in Example 18 was changed to 100 parts by weight of paraffin wax, and the paraffin wax was coated on the mat layer 6 in a deposition of 1.5 g/m$^2$ on a dry basis, by the hot-melt coating method, whereby a comparative thermosensitive image transfer recording medium No. 4 was prepared.

Each of the thus obtained thermosensitive image transfer recording media No. 18 to No. 22 according to the present invention and the comparative thermosensitive image transfer recording medium No. 4 was incorporated in a thermosensitive image transfer printer. A sheet of high quality paper was brought into close contact with the thermofusible ink layer side of the thermosensitive image transfer recording medium, so that an image transfer recording test was performed with the application of a thermal energy of 0.5 mJ/dot for printing images on a transfer sheet to evaluate the printed images.

Furthermore, the thus obtained images by use of each thermosensitive image transfer recording medium were subjected to an abrasion test using a commercially available rub tester (made by Toyo Seiki Seisaku-Sho, Ltd.) with a piece of corrugated board attached thereto. The abrasion resistance of the obtained images was evaluated at 20° C. and 50° C. The glossiness of the obtained images was also measured.

The results are shown in Table 2.

TABLE 2

| | Example No. | | | | | Comparative Example No. |
|---|---|---|---|---|---|---|
| | 18 | 19 | 20 | 21 | 22 | 4 |
| Image Density | 1.37 | 1.35 | 1.35 | 1.36 | 1.55 | 1.33 |
| Image Sharpness | ○ | ○ | ○ | ○ | ○ | ○~Δ |
| Abrasion Resistance | ○ | ○ | ○ | ○ | ○ | x |
| Image Glossiness (%) | 14 | 15 | 15 | 60 | 19 | |

○: Good
Δ: Poor
x: No good

As previously mentioned, when the thermosensitive image transfer recording medium comprises the mat layer formed between the support and the release layer, the thermosensitive image transfer recording medium can yield clear images with a high image density, and the thus obtained images are excellent in the abrasion resistance. In particular, the thus obtained images are appropriately delustered, so that they can be accurately read by a bar code reader and are comfortably clear to the naked eye.

What is claimed is:

1. A thermosensitive image transfer recording medium, capable of yielding images under application of heat by a thermal head, comprising a support, a release layer formed thereon comprising as the main components an unvulcanized rubber and a thermofusible wax component, and a thermofusible ink layer comprising a coloring agent and a thermofusible resin component, formed on said release layer.

2. The thermosensitive image transfer recording medium as claimed in claim 1, wherein said thermofusible ink layer further comprises a thermofusible wax component.

3. The thermosensitive image transfer recording medium as claimed in claim 2, wherein said thermofusible wax component in said thermofusible ink layer is selected from the group consisting of natural waxes, synthetic waxes, higher fatty acids and metallic salts thereof, higher alcohols, higher fatty acid esters, and higher fatty acid amides.

4. The thermosensitive image transfer recording medium as claimed in claim 3, wherein said thermofusible wax component in said thermofusible ink layer is selected from the group consisting of carnauba wax, montan wax, high density polyethylene wax, higher fatty acids and metallic salts thereof.

5. The thermosensitive image transfer recording medium as claimed in claim 2, wherein the weight ratio of said coloring agent, said thermofusible wax component and said thermofusible resin in said thermofusible ink layer is in the range to (5 to 50):(30 to 90):(5 to 50).

6. The thermosensitive image transfer recording medium as claimed in claim 1, wherein said release layer comprises two sub-release layers which are successively overlaid on said support, one of said sub-release layers comprising said thermofusible wax component, and the other sub-release layer comprising said unvulcanized rubber and said thermofusible wax component.

7. The thermosensitive image transfer recording medium as claimed in claim 6, wherein one of said sub-release layers is formed on said support and has a thickness ranging from 0.1 to 2 μm, and said other sub-release layer is formed on said first sub-release layer and has a thickness ranging from 0.2 to 3 μm.

8. The thermosensitive image transfer recording medium as claimed in claim 7, wherein said one of said sub-release layers has a thickness ranging from 0.5 to 1.5 μm and said other sub-release layer has a thickness ranging from 0.5 to 2.0 μm.

9. The thermosensitive image transfer recording medium as claimed in claim 1, wherein said unvulcanized rubber in said release layer is selected from the group consisting of polyisoprene, polybutadiene, styrenebutadiene rubber, nitrile rubber, ethylene propylene rubber, butyl rubber, silicone rubber, fluororubber and urethane rubber.

10. The thermosensitive image transfer recording medium as claimed in claim 9, wherein said unvulcanized rubber in said release layer is selected from the group consisting of polyisoprene, polybutadiene, ethylene propylene rubber, butyl rubber, and nitrile rubber.

11. The thermosensitive image transfer recording medium as claimed in claim 1, wherein said unvulcanized rubber in said release layer has a melting point ranging from 60° C. to 200° C.

12. The thermosensitive image transfer recording medium as claimed in claim 1, wherein the amount ratio by parts by weight of said unvulcanized rubber to said thermofusible wax component in said release layer is in the range of (5~95) to (95~5).

13. The thermosensitive image transfer recording medium as claimed in claim 12, wherein the amount ratio by parts by weight of said unvulcanized rubber to said thermofusible wax component in said release layer is in the range of (30~70) to (70~30).

14. The thermosensitive image transfer recording medium as claimed in claim 1, wherein the thickness of said release layer is in the range of 0.2 to 5 μm.

15. The thermosensitive image transfer recording medium as claimed in claim 14, wherein the thickness of said release layer is in the range of 1 to 4 μm.

16. The thermosensitive image transfer recording medium as claimed in claim 1, wherein said thermofusible resin component in said thermofusible ink layer is selected from the group consisting of polyamide resin, polyester resin, polyurethane resin, vinyl chloride resin, cellulosic resin, petroleum resin, styrene resin, butyral resin, phenolic resin, ethylene-vinyl acetate copolymer and ethylene-acrylic resin.

17. The thermosensitive image transfer recording medium as claimed in claim 1, wherein said thermofusible ink layer has a thickness of 0.5 to 5 μm.

18. The thermosensitive image transfer recording medium as claimed in claim 17, wherein said thermofusible ink layer has a thickness of 1 to 3 μm.

19. The thermosensitive image transfer recording medium as claimed in claim 1, wherein said thermofusible wax component in said release layer is selected from the group consisting of natural waxes, synthetic waxes, higher fatty acids and metallic salts thereof, higher alcohols, higher fatty acid esters, and higher fatty acid amides.

20. The thermosensitive image transfer recording medium as claimed in claim 19, wherein said thermofusible wax component in said release layer is selected from the group consisting of carnauba wax, montan wax, high density polyethylene wax, higher fatty acids, and metallic salts thereof.

21. The thermosensitive image transfer recording medium as claimed in claim 1, further comprising a mat layer which is interposed between said support and said release layer.

22. The thermosensitive image transfer recording medium as claimed in claim 21, wherein said thermofusible ink layer further comprises a thermofusible wax component.

23. The thermosensitive image transfer recording medium as claimed in claim 22, wherein said thermofusible wax component in said thermofusible ink layer is selected from the group consisting of natural waxes, synthetic waxes, higher fatty acids and metallic salts thereof, higher alcohols, higher fatty acid esters, and higher fatty acid amides.

24. The thermosensitive image transfer recording medium as claimed in claim 23, wherein said thermofusible wax component in said thermofusible ink layer is selected from the group consisting of carnauba wax, montan wax, high density polyethylene wax, higher fatty acids and metallic salts thereof.

25. The thermosensitive image transfer recording medium as claimed in claim 22, wherein the weight ratio of said coloring agent, said thermofusible wax component and said thermofusible resin in said thermofusible ink layer is in the range (5 to 50):(30 to 90):(5 to 50).

26. The thermosensitive image transfer recording medium as claimed in claim 21, further comprising an overcoat layer on said thermofusible ink layer, said overcoat layer comprising a component selected from the group consisting of a thermofusible wax component, and a mixture of a thermofusible wax component and a thermofusible resin component.

27. The thermosensitive image transfer recording medium as claimed in claim 26, wherein said overcoat layer has a thickness of 0.2 to 3 μm.

28. The thermosensitive image transfer recording medium as claimed in claim 27, wherein said overcoat layer has a thickness of 0.5 to 2 μm.

29. The thermosensitive image transfer recording medium as claimed in claim 21, wherein said release layer comprises two sub-release layers which are successively overlaid on said support, one of said sub-release layers comprising said thermofusible wax component, and the other sub-release layer comprising said unvulcanized rubber and said thermofusible wax component.

30. The thermosensitive image transfer recording medium as claimed in claim 29, further comprising an overcoat layer on said thermofusible ink layer, said overcoat layer comprising a component selected from the group consisting of (i) a thermofusible wax component and (ii) a mixture of a thermofusible wax component and a thermofusible resin component.

31. The thermosensitive image transfer recording medium as claimed in claim 29, wherein one of said sub-release layers is formed on said support and has a thickness ranging from 0.1 to 2 μm, and said other sub-release layer is formed on said first sub-release layer and has a thickness ranging from 0.2 to 3 μm.

32. The thermosensitive image transfer recording medium as claimed in claim 31, wherein said one of said sub-release layers has a thickness ranging from 0.5 to 1.5 μm and said other sub-release layer has a thickness ranging from 0.5 to 2.0 μm.

33. The thermosensitive image transfer recording medium as claimed in claim 21, wherein said mat layer comprises finely-divided particles of a pigment and a binder agent.

34. The thermosensitive image transfer recording medium as claimed in claim 33, wherein said pigment in said mat layer is an organic material selected from the group consisting of silicone resin and polytetrafluoroethylene.

35. The thermosensitive image transfer recording medium as claimed in claim 33, wherein said pigment in said mat layer is an inorganic material selected from the group consisting of silicone-coated silica, clay, alumina, titanium oxide and zinc oxide.

36. The thermosensitive image transfer recording medium as claimed in claim 33, wherein said pigment in said mat layer has a particle size ranging from 0.1 μm to 3 μm.

37. The thermosensitive image transfer recording medium as claimed in claim 33, wherein said binder agent in said mat layer is selected from the group consisting of polyester resin, vinyl chloride-vinyl acetate copolymer, ethylcellulose and epoxy resin.

38. The thermosensitive image transfer recording medium as claimed in claim 33, wherein the weight ratio of said pigment to said binder agent in said mat layer is in the range of (1:20) to (5:1).

39. The thermosensitive image transfer recording medium as claimed in claim 21, wherein said unvulcanized rubber in said release layer is selected from the group consisting of polyisoprene, polybutadiene, styrenebutadiene rubber, nitrile rubber, ethylene propylene rubber, butyl rubber, silicone rubber, fluororubber and urethane rubber.

40. The thermosensitive image transfer recording medium as claimed in claim 39, wherein said unvulcanized rubber in said release layer is selected from the group consisting of polyisoprene, polybutadiene, ethylene propylene rubber, butyl rubber, and nitrile rubber.

41. The thermosensitive image transfer recording medium as claimed in claim 21, wherein said unvulcanized rubber in said release layer has a melting point ranging from 60° C. to 200° C.

42. The thermosensitive image transfer recording medium as claimed in claim 21, wherein the amount ratio by parts by weight of said unvulcanized rubber to said thermofusible wax component in said release layer is in the range of (5~95) to (95~5).

43. The thermosensitive image transfer recording medium as claimed in claim 42, wherein the amount ratio by parts by weight of said unvulcanized rubber to said thermofusible wax component in said release layer is in the range of (30~70) to (70~30).

44. The thermosensitive image transfer recording medium as claimed in claim 21, wherein the thickness of said release layer is in the range of 0.2 to 5 μm.

45. The thermosensitive image transfer recording medium as claimed in claim 44, wherein the thickness of said release layer is in the range of 1 to 4 μm.

46. The thermosensitive image transfer recording medium as claimed in claim 21, wherein said thermofusible resin component in said thermofusible ink layer is selected from the group consisting of polyamide resin, polyester resin, polyurethane resin, vinyl chloride resin, cellulosic resin, petroleum resin, styrene resin, butyral resin, phenolic resin, ethylene-vinyl acetate copolymer and ethylene-acrylic resin.

47. The thermosensitive image transfer recording medium as claimed in claim 21, wherein said thermofusible ink layer has a thickness of 0.5 to 5 μm.

48. The thermosensitive image transfer recording medium as claimed in claim 47, wherein said thermofusible ink layer has a thickness of 1 to 3 μm.

49. The thermosensitive image transfer recording medium as claimed in claim 21, wherein said thermofusible wax component in said release layer is selected from the group consisting of natural waxes, synthetic waxes, higher fatty acids and metallic salts thereof, higher alcohols, higher fatty acid esters, and higher fatty acid amides.

50. The thermosensitive image transfer recording medium as claimed in claim 49, wherein said thermofusible wax component in said release layer is selected from the group consisting of carnauba wax, montan wax, high density polyethylene wax, higher fatty acids, and metallic salts thereof.

51. The thermosensitive image transfer recording medium as claimed in claim 21, wherein said mat layer has a thickness of about 1 to 10 μm.

* * * * *

UNITED STATES PATENT AND TRADEMARK OFFICE

CERTIFICATE OF CORRECTION

PATENT NO. : 5,045,383

DATED : September 3, 1991

INVENTOR(S) : Maeda et al.

It is certified that error appears in the above-identified patent and that said Letters Patent is hereby corrected as shown below:

Column 5, line 59, "a unvulcanized" should read -- an unvulcanized --;

Column 5, line 63, "This is because of" should read -- This is because --.

Column 7, line 28, "(C.I. 77103)" should read -- (C.I. No. 77103) --;

Column 7, line 31, "C.I. No. 47005)," should read --(C.I. No. 47005), --.

Column 19, line 26, "ink layer 3q" should read -- ink layer 3a --;

Column 19, line 45, "thermoensitive" should read -- thermosensitive --.

UNITED STATES PATENT AND TRADEMARK OFFICE

CERTIFICATE OF CORRECTION

PATENT NO. : 5,045,383

DATED : September 3, 1991

INVENTOR(S) : Maeda et al.

It is certified that error appears in the above-identified patent and that said Letters Patent is hereby corrected as shown below:

Column 20, line 46, "

TABLE 2

| | Example No. | | | | | Comparative Example No. |
|---|---|---|---|---|---|---|
| | 18 | 19 | 20 | 21 | 22 | 4 |
| Image Density | 1.37 | 1.35 | 1.35 | 1.36 | 1.55 | 1.33 |
| Image Sharpness | ○ | ○ | ○ | ○ | ○ | ○ ~ Δ |
| Abrasion Resistance | ○ | ○ | ○ | ○ | ○ | x |
| Image Glossiness (%) | 14 | 15 | 15 | 60 | 19 | |

○: Good
Δ: Poor
x: No good

"

UNITED STATES PATENT AND TRADEMARK OFFICE
CERTIFICATE OF CORRECTION

PATENT NO. : 5,045,383

DATED : September 3, 1991

INVENTOR(S) : Maeda et al.

It is certified that error appears in the above-identified patent and that said Letters Patent is hereby corrected as shown below:

should read--

TABLE 2

| | Example No. | | | | | Comparative Example No. |
|---|---|---|---|---|---|---|
| | 18 | 19 | 20 | 21 | 22 | 4 |
| Image Density | 1.37 | 1.39 | 1.39 | 1.36 | 1.59 | 1.33 |
| Image Sharpness | ○ | ○ | ○ | ○ | ○ | ○~△ |
| Abrasion Resistance | ○ | ○ | ○ | ○ | ○ | × |
| Image Gloss (%) | 19 | 14 | 15 | 19 | 60 | 19 |

○: Good
△: Poor
×: No good

--.

Signed and Sealed this

Eighth Day of June, 1993

Michael K. Kirk

MICHAEL K. KIRK

*Acting Commissioner of Patents and Trademarks*

*Attest:*

*Attesting Officer*